US005531177A

United States Patent [19]

Urbank

[11] Patent Number: 5,531,177

[45] Date of Patent: Jul. 2, 1996

[54] ROLLER CONSTRUCTION FOR THE LAUNCHING AND RECOVERY OF PERSONAL WATERCRAFT

[76] Inventor: Vincent Urbank, 609 Elizabeth Ter., Toms River, N.J. 08753

[21] Appl. No.: 415,563

[22] Filed: Apr. 3, 1995

[51] Int. Cl.[6] ..... B63C 1/02

[52] U.S. Cl. ..... 114/48; 114/366

[58] Field of Search ..... 114/44–48, 366; 187/11; 405/3

[56] References Cited

U.S. PATENT DOCUMENTS 2,761,571 9/1956 Adams ..... 114/366

4,482,268 11/1984 Stevenson et al. ..... 114/44

5,245,940 9/1993 Rockwood ..... 114/48

*Primary Examiner*—Jesus D. Sotelo

*Attorney, Agent, or Firm*—Charles I. Brodsky

[57] ABSTRACT

The roller construction of the invention affords a high degree of support and stability to the launching and recovery of personal watercraft by lowering and raising a cradle through the use of rollers, some of which are positioned above the cradle while others of which are positioned below the cradle—and wherein each roller bears against a side of a polygonal-shaped vertical post along which the cradle rides.

4 Claims, 3 Drawing Sheets

ROLLER CONSTRUCTION FOR THE LAUNCHING AND RECOVERY OF PERSONAL WATERCRAFT

FIELD OF THE INVENTION

This invention relates to launching and recovery devices for personal watercraft, in general, and to a roller construction for providing an enhanced degree of support and stability to a cradle which lowers and raises the watercraft along a vertical post, in particular.

BACKGROUND OF THE INVENTION

Such launching and recovery devices have been described in the prior art in patents to Rockwood (U.S. Pat. No. 5,245,940) and Montgomery (U.S. Pat. Nos. 4,983,067 & 5,090,842). By and large, each of those arrangements incorporate an elongated vertical post having separable upper and lower portions, with the lower portion having a lower end driven into the ground bottom beneath the water adjacent a dock or seawall and an upper end which is disposed at the upper edge of this dock or seawall, a connection between the upper end of the lower post portion and the dock or seawall, a winch mounted on an upper end of the upper post portion and rotatable therewith, a cradle for supporting the watercraft cantilevered on the post and extending laterally from it to slide along the post and a hoist extending between the winch and cradle for raising and lowering the cradle during operation. Each of those inventions further utilize a roller construction between the post and cradle for supporting the cradle on the post during vertical movement.

One skilled in the art, in reviewing such patents would first of all note that the roller constructions employed are quite complex. In Rockwood, for example, there are what are termed "load supporting rollers", "side rollers", and several other types of rollers required for the described operation, but not given any descriptive name. While the rollers there discussed may very well be sufficient in supporting a cradle when moving jet skis of the order of 250–400 pounds, one skilled in the art would very well understand that different roller constructions and sizes would very well be needed if the cradle were being used to raise and lower larger watercraft—whether they be 800 pounds, 1,000 pounds, 1,200 pounds, or whatever. Although one way of dealing with such situations might very well involve increasing the dimensions of the elongated vertical post there utilized to increase stability, that would still not be the complete story as different rollers of increased bearing capacity would still be required, even if the large numbers of rollers employed were not susceptible to breakdown or failure during repeated use; obviously, the greater the number of rollers and the complexity involved, the greater the propensity for something to go wrong. Similarly, with the Montgomery designs, changes are required, of necessity, in the roller construction as added watercraft weights are encountered, else the stability of the provided support will suffer if not lead to failure.

OBJECTS OF THE INVENTION

It is an object of the present invention, therefore, to provide a new and improved roller construction which is simpler than those available in the prior art, and which can sustain a wide variety of watercraft weights reliably.

It is another object of the present invention to provide such a roller construction which will reduce the number of components that must be maintained by a service organization in installing lift systems to accommodate different size watercraft.

SUMMARY OF THE INVENTION

As will become clear from the following description, the roller construction of the present invention operates in conjunction with the particular cross-sectional shape of the vertical post employed to have a plurality of rollers equal in number to the number of sides of the vertical post, some of which are to be positioned against sides of the post above the watercraft supporting cradle, and with other individual ones of the rollers being positioned against other sides of the vertical post below the cradle support. In a preferred construction, with a vertical post of square cross-sectional shape of four adjacent surfaces, a first pair of such rollers are positioned against two of the four adjacent surfaces of the cross-sectionally square post above the cradle, with a second such pair positioned against the remaining two of the four adjacent surfaces below the cradle. In accordance with this preferred embodiment, furthermore, such first pair of rollers are additionally positioned directly opposite from the second such pair of rollers, in providing support for each of the surfaces of the post along which the cradle rides. To further add to the support, such rollers of the invention are fabricated of a rubber, or rubber-composition material, to be both long lasting and resistant to a saltwater environment, in extending the usefulness of the construction. In essence, and as will be appreciated by those skilled in the art, the construction afforded in this manner is essentially that of a "double axle", applying support to two sides simultaneously, as contrasted with the single, one-sided support at any one time of the prior art constructions. By further increasing the size of the individual rollers to begin with, additionally, any instance of misalignment in riding the cradle up and down under action of the winch is likewise minimized, in avoiding any need for maintaining rollers in precise alignment, as characterized the Rockwood arrangement, for example. Such rollers, according to the invention, may be of a diameter of 6 inches or so, and of a thickness approximating 2 inches.

BRIEF DESCRIPTION OF THE DRAWINGS

These and other features of the present invention will be more clearly understood from the consideration of the following description, taken in connection with the accompanying drawing in which.

DETAILED DESCRIPTION OF THE DRAWINGS

Figure 1:
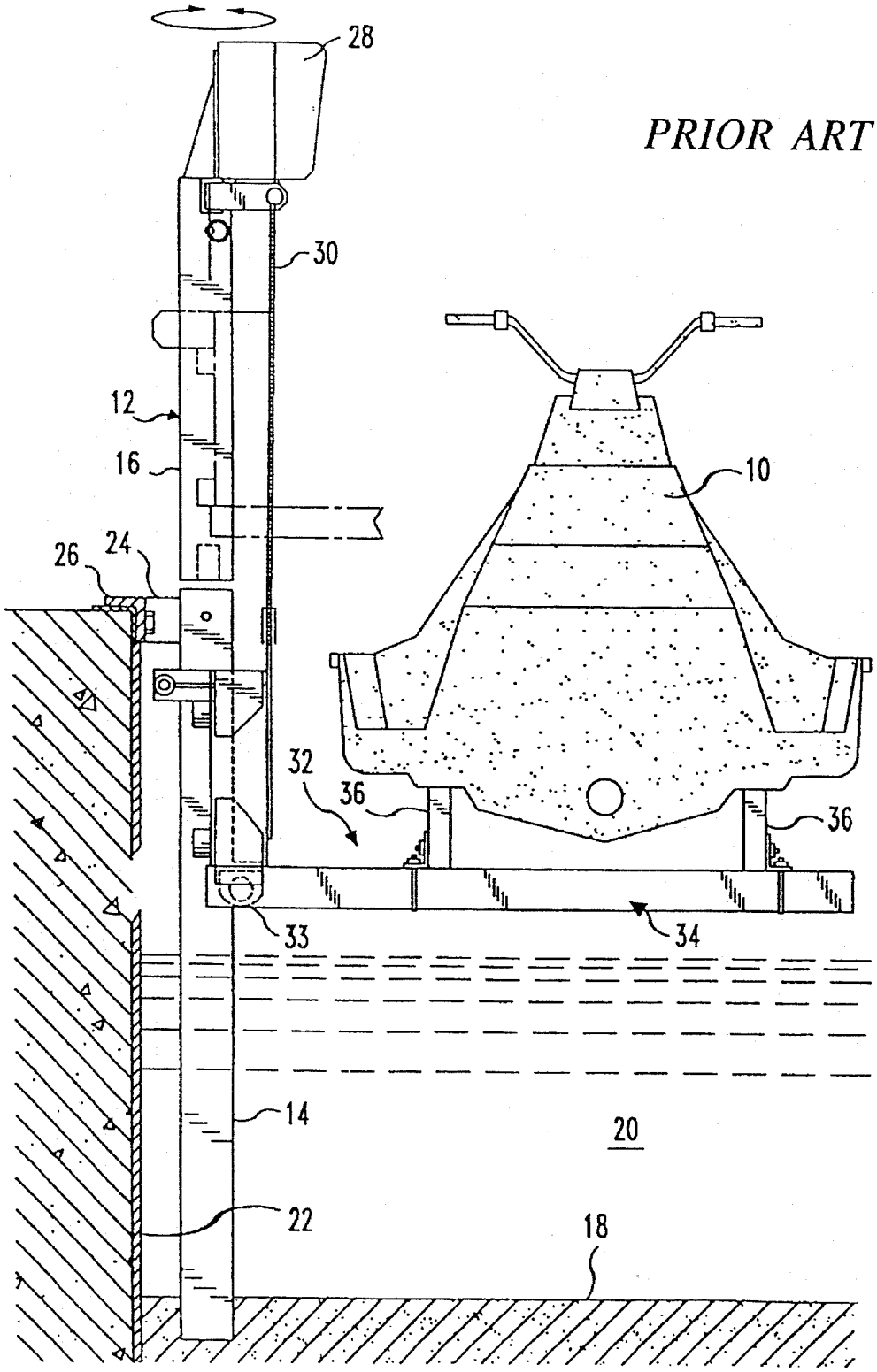
FIG. 1 illustrates a type of watercraft launching and recovery device typifying the prior art, and as illustrated in the Rockwood U.S. Pat. No. 5,245,940.

Referring to the prior art configuration of FIG. 1, in raising and lowering personal watercraft 10, the arrangement comprises an elongated vertical post 12, generally of polygonal cross-sectional shape having a lower post portion 14 and a separable upper post portion 16. As indicated, the lower post portion 14 is intended to be driven (or jetted) at its lower end into the ground bottom 18 beneath the water 20 adjacent a dock or seawall 22 prior to mounting the upper post portion 16 thereon. A bracket 24 is secured to the dock or seawall 22 to stabilize the upper end 26 of the lower post portion 14, with the upper end 26 being substantially flush with the top of the dock or seawall 22, as shown.

Mounted on the top of the upper post portion 16 is a winch 28 provided with a cable 30 as a hoist for connecting the winch 28 to the watercraft supporting cradle 32. Such supporting cradle 32 is cantilevered on the vertical post 12 and extends laterally therefrom for vertically sliding movement therealong, and between the upper and lower post portions 16, 14, while being arranged to be disposed beneath the watercraft 10 in its raising or lowering. As shown, the cradle 32 comprises a horizontal platform 34 consisting of laterally spaced tubular members across which are secured a pair of watercraft supporting bunks 36 upon which the watercraft 10 sits when lifted or lowered—although in other constructions, the bunks 36 may be in the form of a series of rollers to facilitate the loading or unloading of the watercraft with a dolly directly onto, or off from, the cradle 32— with the dolly being of a type having its own roller arrangements to ease its loading and off-loading of the watercraft at the dock or pier. In accordance with the invention, the cradle 32 is mounted on the post 12 for vertical sliding movement, and is to be guided against uncontrolled rotation in a manner now to be described, as embodying the invention.

Figure 2:
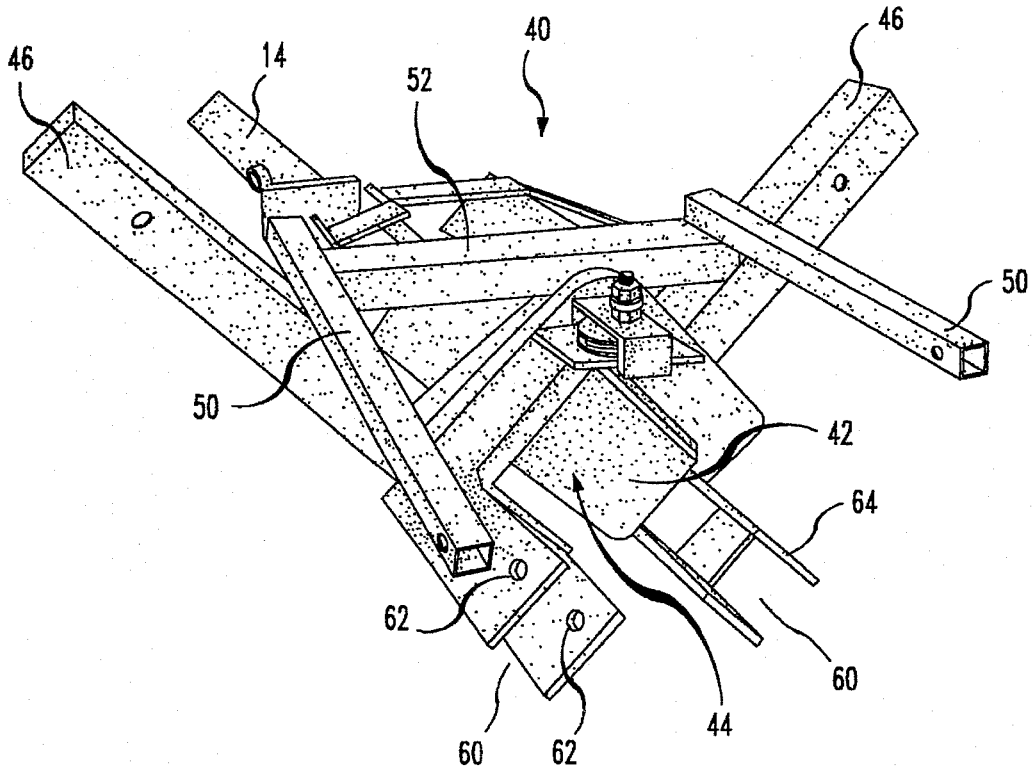
FIGS. 2 and 3 illustrate an apparatus for holding four rollers in position in moving the watercraft supporting cradle along an elongated post of square cross-sectional shape.

In FIG. 2 a construction termed a "car" 40 is shown. Such car 40 is arranged to ride up-and-down on the vertical post 12, and with the construction of FIGS. 2 and 3, understood to be intended for use with a vertical post 12 of square cross-sectional shape. Having a central section 42 of a corresponding "square" configuration to secure with the vertical post 12 by a slip fit, and extending through the car 40, the section 42 is further provided with a slot 44 which is aligned to pass over the bracket 24 in allowing the car 40 to travel its length without impediment. Once such car 40 is raised by the winch 28 onto the upper post portion 16, in addition, the car 40 is free to pivot 360°, in bringing the watercraft 10 from a point over-the-water, to a point over the dock or seawall 22, by either clockwise, or counterclockwise, rotation.

FIG. 2 illustrates the lower post portion 14 about to enter the section 42, with it being understood that the bottom end of the upper post portion 16 slides into the section 42 at the top, as at 100.

Figure 5:
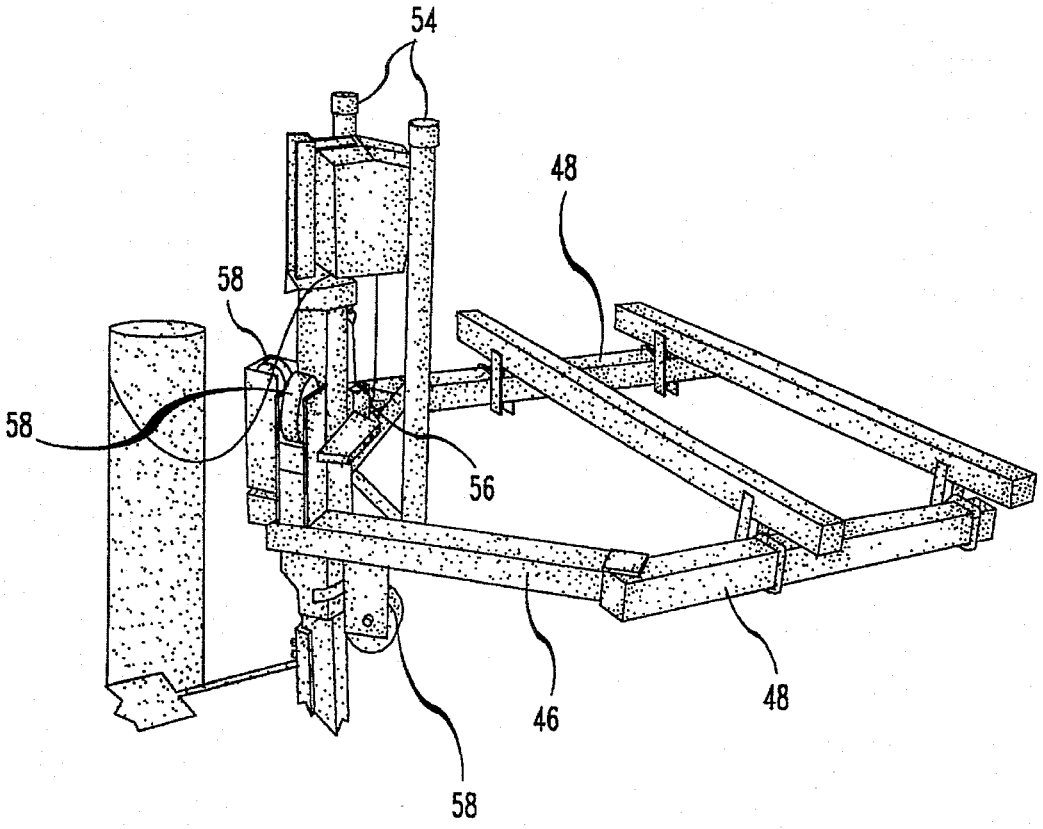
FIG. 5 shows the cradle support along with roller construction in place for the preferred embodiment of the square-shaped cross-sectional post along which the cradle and its watercraft ride.

A pair of bars 46 secure to the section 42 as illustrated, being of tubular cross-section, for example, to accept a pair of arms 48, to be then bolted thereto in extending out to couple with the remainder of the cradle 32, at the horizontal platform 34 (FIG. 5). A pair of further posts 50 join with a crosspiece 52 at the section 42, in acting as a "stop" in protecting the sides of a loaded watercraft— and, to such extent, may be covered with a protective polyvinylchloride pipe, or other such material, as shown at 54 in FIG. 5. The hoist cable 30 of the winch 28 further connects around a grooved annular wheel 56 in raising and lowering the car 40 and the connected cradle 32—again as shown in FIG. 5.

Figure 3:
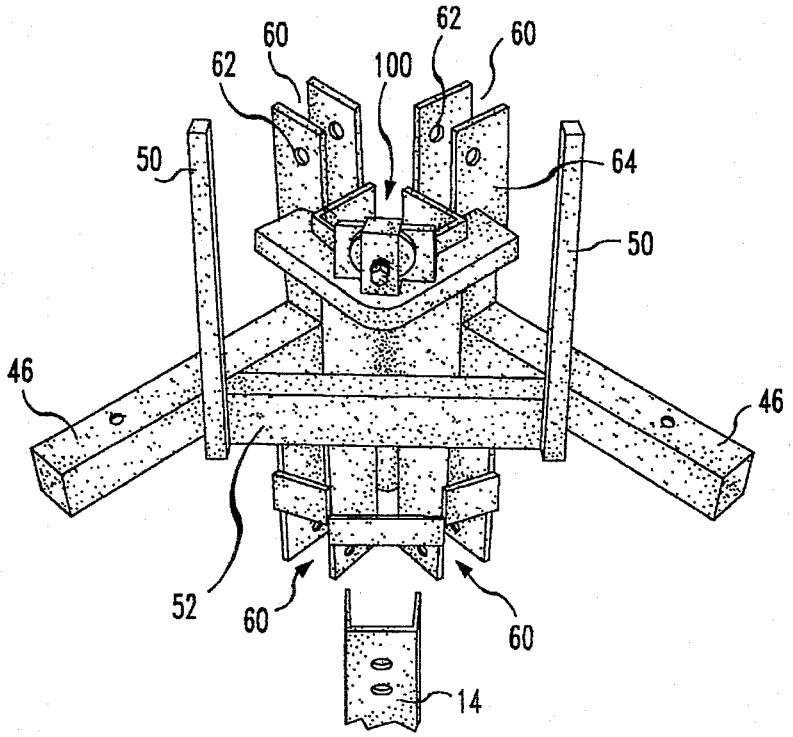
Figure 4:
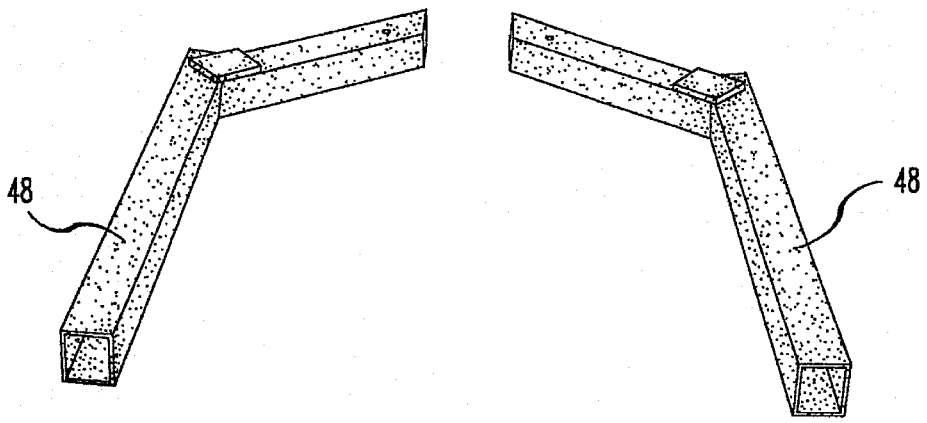
FIG. 4 shows a pair of arms that couple to the apparatus of FIGS. 2 and 3 in forming the watercraft cradle support.

As previously mentioned, and in accordance with the invention, added support and stability is provided through the use of rollers 58 (FIG. 5) in the nature of a series of wheels, one bearing against each side of the polygonal cross-section shape of the vertical post 12, and of its separable upper and lower post portions 16, 14, respectively. To effectuate this—and as shown in FIGS. 2 and 3, a series of recesses 60 are shown (four recesses for the preferred construction with the square-shaped vertical post 12) into which each of the rollers 58 are to be secured, and by means of a bolt traversing the pair of aligned apertures 62 in the bracketed sides 64 of the recesses 60 (where the bolt is secured), and through a central aperture along the axis of the rollers 58. As more particularly shown in FIG. 5, these rollers, in accordance with the preferred embodiment of the invention, are in the nature of wheels of hard rubber, or rubber composition material, and of a diameter of 6 inches or so, and of a thickness of approximately 2 inches, in riding up and down a vertical post 12 in the nature of a 3"×3" tube, secured to each bracketed side.

As more clearly shown in FIG. 5, two of the roller wheels 58 are located above the cradle 32, while the remaining two are shown as located beneath the cradle. As is shown there (and also as will be seen from FIG. 3), the two roller wheels 58 positioned above the cradle 32 are located so as to bear against adjacent sides of the vertical post 12, while the other two roller wheels 58 are located below the cradle 32 in opposite orientation, so as to bear against the remaining two walls of the square-shaped vertical post 12. In such manner, as will be appreciated by those skilled in the art, each of the roller wheels 58 are in constant contact with one side of the vertical post 12, to the extent that all such sides are contacted, both in providing support for the vertical post 12 and for allowing a smooth ride up-and-down by the cradle 32. At the same time, by having the thickness of the roller wheel 58 almost comparable to the side dimension of the vertical post square, any degree of misalignment that might occur with the roller wheel 58 in use is of a little moment as almost the entire surface area is contacted. And, in similar manner, by having such 6 inch diameter dimension, or so, for the roller wheel 58, a greater degree of support is afforded than if it were of a smaller diameter.

With the construction as thusly described, it will be appreciated that the two "double-axle" supports on the rollers 58, and on all side surfaces of the vertical post 12 strengthens the support, and the ability to sustain the weight of the personal watercraft 10. By having the "double-axle" construction above and below the cradle 32 (as shown in FIG. 5), the support provided is increased. For those instances where very large weighted watercraft are to be lowered and raised—for example, 1,200 pounds, all that would be required would be to possibly increase the dimension of the square vertical post tubing from 3"×3" to 4"×4" (or to 5"×5"), and to correspondingly increase the diameter of the roller wheel 58 and/or its thickness in like manner. As will be evident, added support is thus afforded in retaining the watercraft in the cantilevered position by the resulting construction, while still allowing for the cradle 32 to swing about the upper post portion 16 in a 360° arc above the dock or seawall 22 to facilitate the off-loading of the watercraft, and the stowing of gear in it, etc.

While there have been described what considered to be preferred embodiments of the present invention, it will be readily apparent to those skilled in the art that modifications can be made without departing from the scope of the teachings herein. Thus, whereas the invention has been particularly described in conjunction with a vertical post construction of square-shaped configuration, it will be understood that the teachings would equally apply for vertical post constructions of any polygonal cross-sectional shape—all that there is then required is that the section 42 of the car 40 be dimensioned to accept the vertical post configuration, and with the roller wheel arrangements and bracketing to be such as to continue to bear one roller wheel against each polygonal surface, with some of the roller wheels being above the cradle, with others being below the cradle, and with individual ones being oppositely positioned with respect to one another in providing the support described and its resistance against bending moments. And, whereas the invention has been particularly described as it might be used with such personal watercraft as 250–450 pound jet skis, its advantages have been noted to follow with larger watercraft, even up to 2,000 pounds and more, with the same degree of support, stability and sturdiness of operation. For at least such reason, therefore, resort should be had to the claims appended hereto for a true understanding of the invention.

I claim:

1. A launching and recovery device for personal watercraft to be installed adjacent a dock or seawall of the type including an elongated vertical post having separable upper and lower portions of polygonal cross-sectional shape, with the lower portion having a lower end for support on the bottom beneath the water adjacent the dock or seawall and an upper end to be disposed at the upper edge of the dock or seawall, a rigid connection between the upper end of the lower post portion to the dock or seawall, a support for the upper post portion on the lower post portion for rotatable movement therebetween about their common axis, with the upper post portion having an upper end and a winch fixedly mounted on such upper end and rotatable therewith; a watercraft supporting cradle cantilevered on the post and extending laterally therefrom for vertically sliding movement therealong and between the upper and lower post portions and arranged to be disposed beneath a watercraft to lift the same and a hoist extending between the winch and cradle for raising and lowering the cradle upon operation of the winch, the improvement comprising roller means disposed between the post and cradle for supporting the cradle on the post for vertical movement and for horizontal rotation, said roller means comprising:

a plurality of rollers equal in number to the number of sides of said polygonal cross-sectional shape post, some individual ones of which are positioned to bear against adjacent sides of said polygonal cross-sectional post above said cradle and other individual ones of which are positioned to bear against other adjacent sides of said polygonal cross-sectional post below said cradle, and wherein the positioning of said plurality of rollers automatically centers said cradle about said post while supporting the weight of said cradle.

2. The improvement of claim 1 for use with an elongated vertical post of square cross-sectional shape of four adjacent sides, including first and second rollers positioned to bear against a first two of said four adjacent surfaces of said square cross-sectional post about said cradle, and third and fourth rollers positioned to bear against a second two of said four adjacent surfaces of said square cross-sectional post below said cradle.

3. The improvement of claim 2 wherein said first two of said four adjacent surfaces, and said second two of said four adjacent surfaces, are oppositely positioned one from another.

4. The improvement of claim 3 wherein said plurality of rollers are fabricated of a rubber or rubber-composition material.

* * * * *